United States Patent [19]

Schibbye et al.

[11] 4,452,575

[45] Jun. 5, 1984

[54] METHOD AND DEVICE FOR INTERMEDIATE COOLING IN AN OIL-INJECTED MULTI-STAGE SCREW COMPRESSOR

[75] Inventors: (Lars) Lauritz B. Schibbye, Älgvägen; Jan Johansson, Gullrisstigen, both of Sweden

[73] Assignee: Svenska Rotormaskiner AB, Stockholm, Sweden

[21] Appl. No.: 357,734

[22] Filed: Mar. 12, 1982

[30] Foreign Application Priority Data

Mar. 13, 1981 [SE] Sweden ..... 8101619
May 19, 1981 [SE] Sweden ..... 8103142

[51] Int. Cl.[3] ..... F01C 1/16; F01C 18/16

[52] U.S. Cl. ..... 418/1; 418/9; 418/100; 418/201

[58] Field of Search ..... 418/9, 10, 97, 100, 418/201, 1; 417/243; 184/6.16

[56] References Cited

U.S. PATENT DOCUMENTS 2,862,656 12/1958 Kadison ..... 417/243
3,910,731 10/1975 Persson ..... 418/9

FOREIGN PATENT DOCUMENTS 1293080 10/1972 United Kingdom ..... 418/97

*Primary Examiner*—Leonard E. Smith
*Assistant Examiner*—Jane E. Obee
*Attorney, Agent, or Firm*—Wood, Dalton, Phillips, Mason & Rowe

[57] ABSTRACT

This invention relates to a method and a device for intermediate cooling in an oil-injected multi-stage screw compressor. Between the outlet (14) in one stage (10) and the inlet (16) in a subsequent stage (11) a connecting passageway (15) is located, through which the gas compressed in the firstmentioned stage (10) is supplied to the subsequent stage (11). For cooling the gas flowing out from the firstmentioned stage (10), in the connecting passageway (15) at least one nozzle (19) is located for the supply of a large cooling oil amount.

19 Claims, 5 Drawing Figures

METHOD AND DEVICE FOR INTERMEDIATE COOLING IN AN OIL-INJECTED MULTI-STAGE SCREW COMPRESSOR

This invention relates to a method and a device for intermediate cooling in an oil-injected multi-stage screw compressor where the gas compressed in one stage is supplied to a subsequent stage for additional compression.

Heretofore oil-injected screw compressors have been marketed substantially designed as one-stage compressors, even for high compression ratios, i.e. up to the magnitude of about 15:1. This has been possible owing to the direct cooling obtained by the injection of large oil amounts into the compression space whereby, due to the turbulent flow conditions prevailing at this compressor type, an efficient heat transfer was obtained, which has prevented the forceful increase in temperature which, even locally, otherwise would have occurred in the compressed gas at such high compression ratios. It was found, thus, that these high compression ratios could be achieved with practically no mechanic or other service interruptions taking place. However, the volumetric and adiabatic efficiencies obtained at such one-stage compression are relatively limited. In view of the ever increasing demand for low energy consumption which has arisen in recent years, compression in multi-stage compressors, especially in two-stage ones, has become a matter of ever increasing interest. The production costs for two-stage screw compressors, however, are substantially, about 70%, higher than for corresponding one-stage compressors. It is, therefore, essential to bring about an improvement of the efficiency, which is of such a magnitude that such a great increase in costs yet is profitable. The two-stage compressors developed so far have not been satisfactory from this point of view.

The present invention, therefore, has the object to bring about a substantial and decisive improvement of the efficiency of oil-injected multi-stage screw compressors, so that such multi-stage compressors, in spite of highest costs, are profitable.

This object is achieved in that the invention has been given the characterizing features defined in the attached claims.

Figure 1:
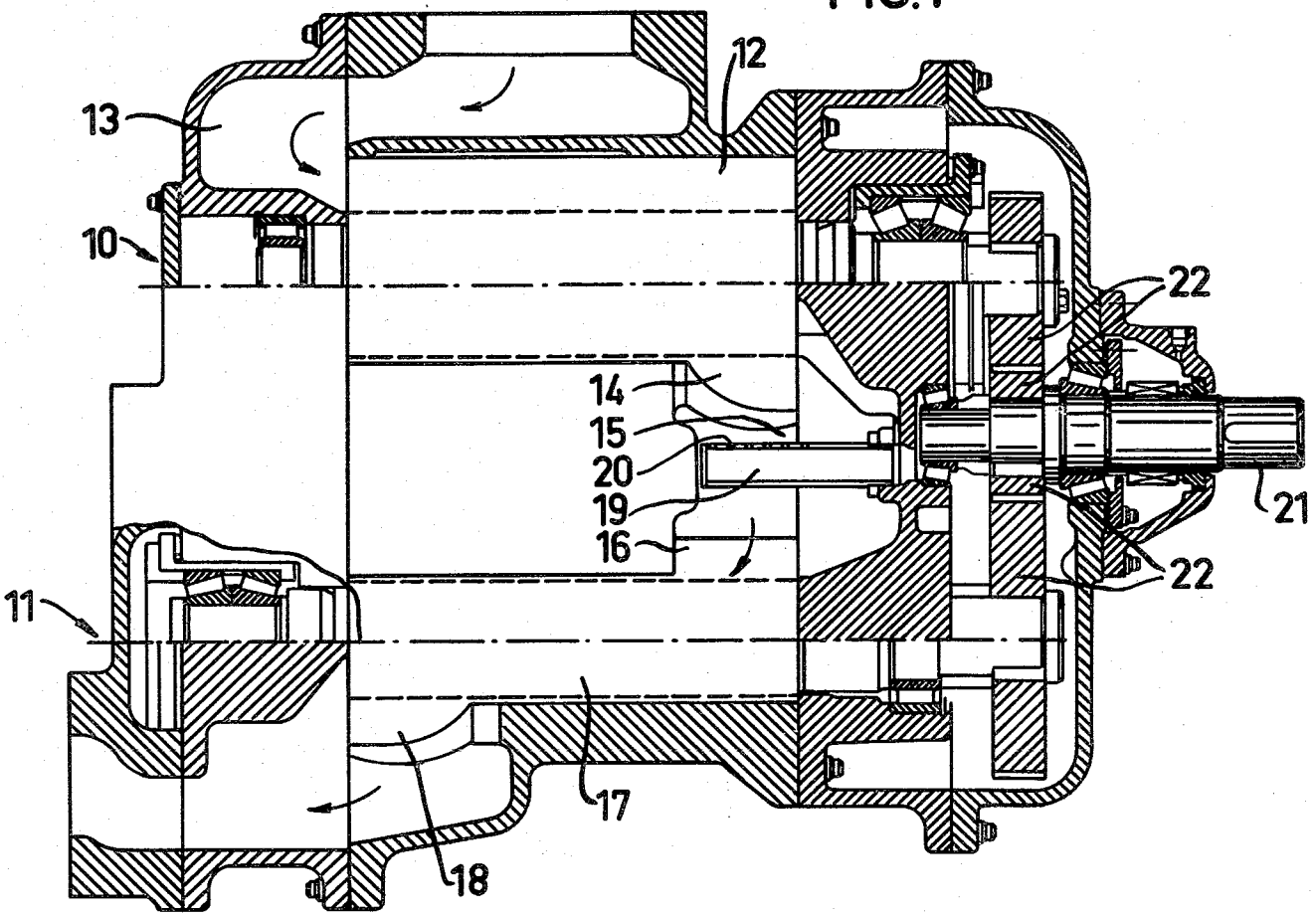
Figure 2:
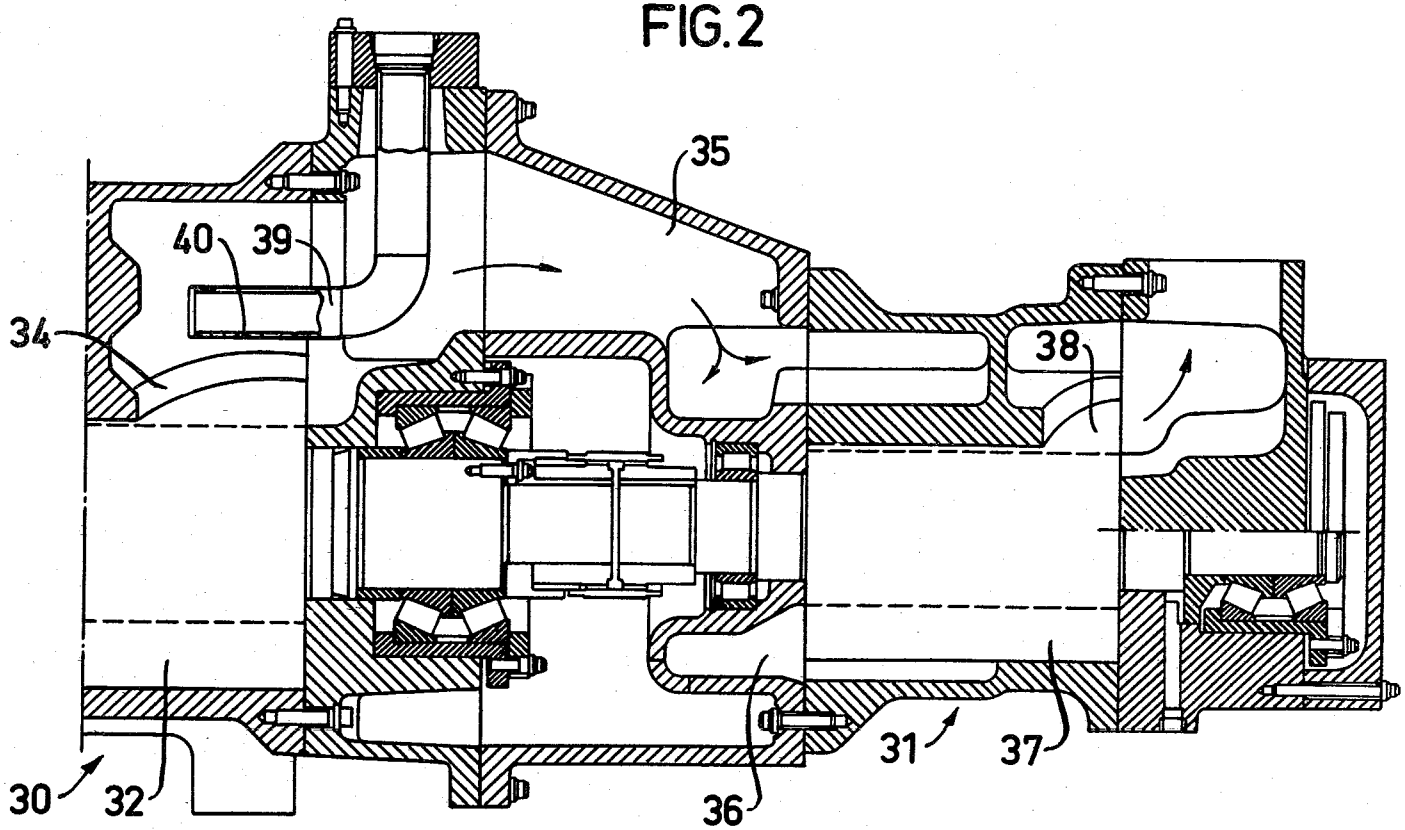
Figure 5:
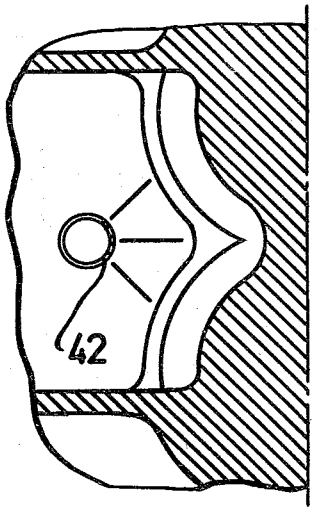
Figure 4:
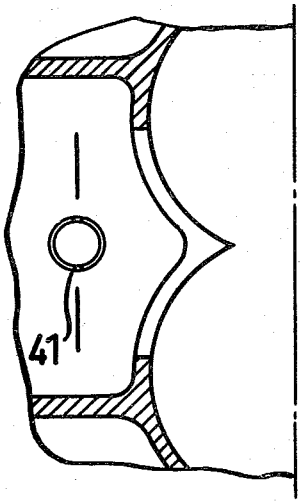
Figure 3:
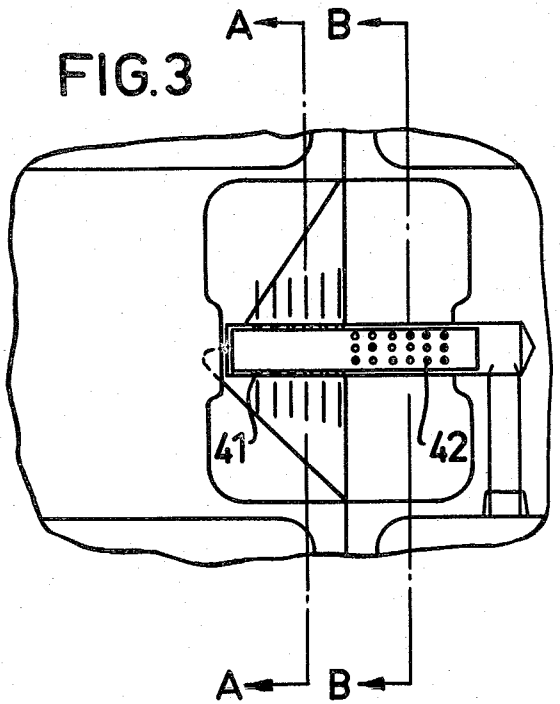

The invention is described in greater detail in the following by way of two embodiments and with reference to the accompanying drawings, in which FIG. 1 is a vertical section through an oil-injected two-stage screw compressor where the second stage is located below the first one and provided with a device for intermediate cooling according to the invention, FIG. 2 is a corresponding section through an oil-injected two-stage screw compressor where the second stage is located aligned after the first one, FIG. 3 is a portion of a longitudinal section seen from above through an alternative nozzle for effecting the intermediate cooling mounted in the screw compressor shown in FIG. 1 and on a slightly larger scale, FIG. 4 is a section after the arrows A—A in FIG. 3, and FIG. 5 is a section after the arrows B—B in FIG. 3.

In FIG. 1, thus, a vertical section through an oil-injected two-stage screw compressor is shown where the first stage 10 is located above the second one 11. In the Figure only the screw rotors in the two stages are shown. The screw rotor 12 of the first stage 10 has at its left-hand end in the Figure an inlet 13, to which air is sucked in from outside. In the first stage the air is transported to the right, whereby it is compressed, and it leaves this stage via a substantially radially located outlet 14. This outlet 14 transforms to a connecting passageway 15, which continues to the inlet 16 for the second stage 11. In this stage, which is provided with a screw rotor 17, the inlet 16 is located to the right in the Figure, and in this second stage the air is transported to the left while being compressed simultaneously. The air after having been compressed completely leaves the second stage via an outlet 18. For cooling the air flowing out from the first stage 10, a nozzle 19 is located in the connecting passageway 15 adjacent the outlet 14 from the first stage, through which nozzle a cooling oil amount is supplied. The nozzle 19 comprises a great number of small orifices 20 facing to the outlet 14 from the first stage for effecting an atomized ejection of the cooling oil. The two screw rotors 12,17 are driven by a common ingoing driven shaft 21, which distributes the power to the two screw rotors via a gear reduction set 22.

FIG. 2 shows a so-called tandem arrangement where the first stage 30 is located aligned before the second stage 31. The screw rotor 32 of the first stage has at its left-hand end (not shown) an inlet (not shown) for the air to be compressed.

In the first stage 30 the air is transported to the right and leaves this stage via a substantially radially located outlet 34. This outlet transforms to a connecting passageway 35 which continues to the inlet 36 for the second stage 31. Also in this stage with its screw rotor 37, the inlet is located to the left in the Figure, and the air is transported while being compressed to the right to the outlet 38. For cooling the air flowing out from the first stage 30, a nozzle 39 for the supply of a cooling oil amount is located in the connecting passageway 35 adjacent the outlet 34 from the first stage. This nozzle 39 includes a great number of small orifices 40 facing to the outlet 34 from the first stage.

The axles of the two screw rotors 32 and 37 are coupled together for simultaneous rotation and are driven by a drive shaft (not shown) located on the left-hand side of the first stage.

A great oil amount, thus, is supplied in the connecting passageway 15,35 between the two compression stages 10 and 11 and, respectively, 30 and 31, preferably in such a way, that this oil amount is sprayed in a plurality of jets to the outlet port 14,34 from the first stage 10, 30, and especially to the zone adjacent the meshing between the two rotors in this stage.

In this zone, namely, a very strong turbulent outflow of the gas prevails, whereby a very efficient heat exchange with the cooling oil injected in the opposite direction is effected. By this efficient heat exchange between the gas flowing out and the cooling oil injected in the connecting passageway 15,35 in the way described above, both a cooling of the outlet portion, with respect to the rotors and the compressor housing in this compression stage 10, 30, and a very efficient intermediate cooling of the gas prior to its supply to the inlet 16,36 of the subsequent compression stage 11,31 are obtained. The greater the amount of cooling oil supplied, the better is the intermediate cooling obtained, but this amount which follows along with the gas into the subsequent compression stage is limited by the condition, that the outlet temperature of the oil-gas mixture from this compression stage must not be lower than a certain minimum temperature, which normally is determined by the dew point temperature for the outlet pressure. No additional oil is required to be supplied to the subsequent compression stage, except to bearings and possible gears.

In certain cases dynamic losses can be caused by the fact, that the cooling oil penetrates inward to the rotating rotors. This can be avoided in that the cooling oil along the extension of the rotors is ejected substantially perpendicularly to the outflowing gas, and in the zone outside the outlet end surface of the rotors is ejected toward the outflowing gas. For this, the nozzles 19 and 39 are designed in a way different of that shown in FIGS. 1 and 2, and their orifices 41 and 42 are arranged in the way shown in FIG. 3. In the portion of the nozzles 19,39 located along the extension of the rotors the orifices 41 are arranged substantially perpendicularly to the direction of the outflowing gas (FIG. 4), i.e. substantially horizontally as the nozzles 19 and 39 are located in the screw compressors according to FIG. 1 and, respectively, 2. In the portion of the nozzles 19,39 which is located outside the outlet end plane of the rotors, however, the orifices 42 are arranged toward the outflowing gas (FIG. 5), i.e. substantially vertically. Said latter orifices 42, however, may be arranged slightly angularly, up to 45°, to the outflowing gas.

To the first compression stage only a very small oil amount is required to be supplied, mainly for lubricating the rotors. Normally an oil amount is supplied to a screw compressor which in relation to the weight of the gas amount supplied to the compressor at full load is about 5:1. In the embodiment according to the invention, this relation can be reduced to about 0.5:1, which implies an oil supply of only about one tenth of the normal supply. Hereby the power required for driving this compression stage has been reduced substantially.

In order to prevent the great oil amount supplied between the compression stages from causing great losses in the inlet of the subsequent compression stage, the rotors in this stage preferably rotate with low peripheral speed, of the magnitude 7–15 m/s. The inlet passageway and the inlet port, besides, are designed so that the flow losses are limited to the greatest possible extent. It was found, that a substantially radial inlet port in this case yields the best inflow conditions, contrary to the purely axial inlet port which normally was used heretofore. The portion of the radial inlet port located in and closest adjacent the meshing of the rotors preferably is covered by a splash plate, the object of which is to direct the hot oil-gas mixture leaking through the rotor meshing to one side of the inlet, preferably to the slide rotor side, so that the smallest possible heat exchange with the inflowing intermediate-cooled oil-gas mixture is obtained.

Though not shown at the embodiments, it is obvious that the method and device according to the invention also can be utilized in screw compressors with more than two stages.

What we claim is:

1. A device for intermediate cooling in an oil injected multi-stage screw compressor having a first stage with meshing rotors to compress gas which exits from said first stage through an output port to a passageway through which said gas is supplied in a main flowing direction to the subsequent stage, said device comprising:

at least one nozzle disposed in said passageway, said nozzle having at least one orifice; and means for supplying oil through said orifice to the compressed gas flowing through said passageway for cooling of said gas, said oil exiting said orifice in a direction at least 90° from the main flowing direction of the gas flowing through said passageway.

2. A device as defined in claim 1, characterized in that the nozzle is located adjacent the outlet from the first stage and is directed toward the direction of the gas flowing out from the outlet.

3. A device as defined in claim 2, characterized in that the nozzle is located adjacent the meshing between the two rotors in the first stage and has an extension corresponding to the axial length of the radial outlet.

4. A device as defined in claim 1, characterized in that the nozzle is formed with a plurality of small orifices for effecting an atomized supply of the cooling oil.

5. A device as defined in claim 1, characterized in that the nozzle is located adjacent the outlet from the first stage and is provided with orifices for the ejection of oil, and that the orifices in the portion of the nozzle located along the extension of the rotors are directed substantially perpendicularly to the direction of the outflowing gas while the orifices in the other portion of the nozzle located outside the outlet end plane of the first stage rotors are directed substantially toward the outflowing gas.

6. A device as defined in claim 5, characterized in that the orifices in the portion of the nozzle located beyond the outlet end plane of the first stage rotors are directed at an angle of between 0° and 45° to the direction of the outflowing gas.

7. A device as defined in claim 5, characterized in that the orifices in the nozzle have a diameter of 1–3 mm.

8. A device as defined in claim 5, characterized in that the number of orifices in the nozzle amounts to 20–100 orifices.

9. A device as defined in claim 8, characterized in that the number of orifices is equally distributed between the two portions of the nozzle.

10. A device as defined in claim 1, characterized in that the outlet from the first mentioned stage and the inlet to the subsequent stage are located substantially radially.

11. A device as defined in claim 10, characterized in that at a multi-stage screw compressor where the stages are located above each other, the outlet from the first stage is directed substantially radially downward and transforms via a connecting passageway extending in the same direction to a substantially radial inlet to the subsequent stage.

12. A method for intermediate cooling in an oil-injected, multi-stage screw compressor of the type wherein gas is compressed in a first stage by meshing rotors and thereafter enters a passageway and flows downstream to the next stage, the method comprising:

injecting oil through at least one nozzle into said gas flowing through said passageway for cooling of said gas.

13. The method described in claim 12 wherein said oil injection includes injecting oil in a direction against the flow of compressed gas.

14. The method described in claim 13 including injecting said oil into said gas adjacent to the meshing rotors of said first stage.

15. The method described in claim 12 including injecting an amount of oil adjacent to the meshing rotors of said first stage in a direction substantially perpendicular to the flow of gas from said first stage and injecting oil against the flow of gas beyond the end plane of the first stage meshing rotors.

16. The method described in claim 15 including injecting an amount of oil adjacent to the meshing rotors of said first stage in a direction substantially perpendicular to the flow of gas and injecting a substantially equal amount of oil against the flow of gas beyond the end plane of the first stage meshing rotors.

17. The method described in claim 12 wherein said next stage also includes meshing rotors, the method further comprising directing said gas mixed with oil from said passageway to said next stage in a substantially radial direction relative to said rotors of said next stage.

18. The method described in claim 12 including injecting an amount of cooling oil to obtain at least a minimum discharge temperature for the compressor.

19. The method described in claim 18 including injecting an amount of cooling oil to obtain at least a minimum discharge temperature for the compressor defined by the dew point temperature of the gas discharged from the compressor.

* * * * *